US011261018B2

(12) United States Patent
McCutchan et al.

(10) Patent No.: US 11,261,018 B2
(45) Date of Patent: Mar. 1, 2022

(54) TOOL FOR DISPENSING VISCOUS MATERIAL FROM A DEFORMABLE TUBE

(71) Applicant: The Gorilla Glue Company LLC, Cincinnati, OH (US)

(72) Inventors: Michael Dean McCutchan, Hamilton, OH (US); Kevin Gampfer, Milford, OH (US); Jeremy Thomas Lacy, Centerville, OH (US); James Joseph Doogan, Cincinnati, OH (US); Mitchell James Wagner, Sugar Grove, IL (US); Nicholas John Wagner, Plano, IL (US); James Troy Starkey, North Haven, CT (US)

(73) Assignee: The Gorilla Glue Company LLC, Cincinnati, OH (US)

( * ) Notice: Subject to any disclaimer, the term of this patent is extended or adjusted under 35 U.S.C. 154(b) by 0 days.

(21) Appl. No.: 16/709,376

(22) Filed: Dec. 10, 2019

(65) Prior Publication Data

US 2020/0189832 A1 Jun. 18, 2020

Related U.S. Application Data

(60) Provisional application No. 62/779,749, filed on Dec. 14, 2019.

(51) Int. Cl.
*B65D 83/00* (2006.01)

(52) U.S. Cl.
CPC ..... *B65D 83/0055* (2013.01)

(58) Field of Classification Search
CPC ..... B65D 83/0055; B65D 83/0094; B65D 35/28; B65D 35/56; B65D 51/18; B32B 27/08; B05C 9/08; B05C 9/10; B43M 11/06
USPC ..... 222/92–107; 428/35.7, 34.1
See application file for complete search history.

(56) References Cited

U.S. PATENT DOCUMENTS

| | | | | |
|---|---|---|---|---|
| 2,210,226 A * | 8/1940 | Weisberger | B65D 35/28 222/103 |
| 2,759,636 A * | 8/1956 | Albert | B65D 35/28 222/103 |
| 3,281,016 A * | 10/1966 | Thompson | B65D 35/28 222/103 |
| 3,938,898 A | 2/1976 | Reitknecht | |
| 4,748,990 A | 6/1988 | Brown et al. | |

(Continued)

FOREIGN PATENT DOCUMENTS

| | | |
|---|---|---|
| CN | 203186657 U | 9/2013 |
| EP | 0579906 B1 | 4/1993 |

(Continued)

OTHER PUBLICATIONS

Extended European Search Report dated Apr. 28, 2020, relating to European Patent Application No. 19215430.3.

*Primary Examiner* — J C Jacyna
(74) *Attorney, Agent, or Firm* — Dinsmore & Shohl LLP

(57) ABSTRACT

A tool which is relatively simple in design, is easy to manufacture and assemble, and which is capable of dispensing precise amounts of the fluid contents of a deformable tube until the contents have been substantially completely dispensed is provided. The tool includes interlocking casing halves and a rigid actuator jaw which is adapted to be pressed against the tube to dispense the contents of the tube.

12 Claims, 11 Drawing Sheets

(56) References Cited

U.S. PATENT DOCUMENTS

| | | | | |
|---|---|---|---|---|
| 5,322,194 | A * | 6/1994 | Roberts | B65D 35/28 222/103 |
| 5,323,932 | A * | 6/1994 | Bauman | B65D 35/28 222/103 |
| 5,501,370 | A | 3/1996 | Okamura et al. | |
| 5,505,342 | A | 4/1996 | Okamura et al. | |
| 5,897,030 | A * | 4/1999 | Stangle | B65D 35/28 222/103 |
| 5,909,828 | A * | 6/1999 | Salisbury | B65D 35/28 222/103 |
| 6,315,165 | B1 | 11/2001 | Regan | |
| 6,669,055 | B1 * | 12/2003 | Coleman | B65D 35/28 222/103 |
| 8,056,748 | B2 | 11/2011 | Chen | |
| 8,714,407 | B2 * | 5/2014 | Frank | B65D 35/28 222/103 |
| 9,309,028 | B2 | 4/2016 | Kealy et al. | |
| 9,669,652 | B2 * | 6/2017 | Kobayashi | B43M 11/06 |
| 2007/0017930 | A1 * | 1/2007 | Gorrie | B65D 35/28 222/103 |
| 2007/0218229 | A1 * | 9/2007 | Nagahama | B65D 35/28 428/35.7 |
| 2009/0224008 | A1 * | 9/2009 | Rushe | B65D 47/122 222/562 |
| 2017/0267413 | A1 | 9/2017 | Qian | |
| 2020/0189832 | A1 * | 6/2020 | McCutchan | B65D 83/0055 |

FOREIGN PATENT DOCUMENTS

| | | | |
|---|---|---|---|
| EP | 0521200 | A2 | 7/1993 |
| EP | 0639510 | A2 | 7/1994 |
| EP | 1091884 | B1 | 6/1999 |
| EP | 2490956 | B1 | 8/2014 |
| EP | 2576373 | A4 | 12/2014 |
| JP | 2003020078 | A | 1/2003 |
| JP | 2003226374 | A | 8/2003 |
| JP | 2004182249 | A | 7/2004 |
| JP | 5212579 | B1 | 6/2013 |
| WO | 2007113244 | A1 | 10/2007 |
| WO | 2013118582 | A1 | 8/2013 |
| WO | 2016090811 | A1 | 6/2016 |
| WO | 2017178487 | A1 | 10/2017 |

* cited by examiner

TOOL FOR DISPENSING VISCOUS MATERIAL FROM A DEFORMABLE TUBE

CROSS REFERENCE TO RELATED APPLICATION

This application claims the benefit of U.S. Provisional Patent Application Ser. No. 62/779,749 filed Dec. 14, 2018, which is hereby incorporated by reference in its entirety.

BACKGROUND

The present invention relates to a tool for dispensing a viscous liquid material or gel such as an adhesive from a deformable tube.

Deformable tubes (for example, aluminum tubes) are often used for containing and dispensing viscous liquids and gels such as, for example, adhesives. It can be difficult, however, to regulate the flow of adhesives or other materials out of deformable tubes. Dispensing adhesives from them can be imprecise and messy, resulting in wasted adhesive. In addition, the user may not squeeze the tube in the correct area, resulting in some of the adhesive remaining trapped in the tube.

Various dispensing devices have been developed to provide a controlled delivery of viscous liquids and gels from deformable tubes. Typically, these devices comprise a container or casing surrounding the tube with buttons or jaws on the container or casing which are manipulated to press against the deformable tube to dispense the viscous material. Examples of such devices are described in U.S. Published Application Nos. 2007/0218229 (Nagahama et al.) and 2009/0179031 (Chen), U.S. Pat. No. 8,714,407 (Frank et al.), and U.S. Pat. No. 6,315,165 (Regan) and U.S. Pat. No. 9,309,028 (Kealy et al). Often, however, these devices include multiple parts which are relatively expensive and complicated to manufacture and/or assemble. Additionally, in many instances, the devices are not capable of dispensing all or even most of the contents of the tubes, resulting in wasted material that the consumer cannot utilize.

Accordingly, the need still exists in this art for a tool which dispenses a precise amount of a viscous liquid or gel material to a surface. The need exists for such a tool to be relatively simple in design, easy to manufacture and assemble, and which is capable of dispensing substantially the entire contents of the deformable tube.

BRIEF SUMMARY

Embodiments of the present invention meet those needs by providing a tool which is relatively simple in design, is easy to manufacture and assemble, and which is capable of dispensing precise amounts of the fluid contents of a deformable tube until the contents have been substantially completely dispensed.

We have invented a tool which maximizes the dispensing of the fluid contents of a deformable tube without deforming the tube neck, the strongest part of the tube. We have found that a device which causes deformation of the tube neck during operation requires different squeezing forces to be applied by a user and results in less than maximal amounts of product being dispensed. Further, we have found that the use of flexible actuator mechanisms can result in less efficient force transfer and less efficient dispensing of product. We have found that using rigid actuator jaws to transfer the entire squeezing force to the tube body results in more efficient dispensing. Further, we have found that an actuator mechanism that extends the entire length of the deformable tube will engage the neck of the tube at some point, causing deformation. We have found that using actuator jaws that extend to just below the tube neck provide for more efficient and complete dispensing of product. Embodiments of the tool of the present invention do not cause tube neck deformation, even at maximum pressure being applied to the tool's actuator jaws.

Embodiments of the present invention utilize an interlocking snap fit design which permits easy assembly and insures that the tool remains intact after being assembled. Guides are provided at several locations to aid in aligning the parts of the tool during assembly. Ratchet mechanisms in the tool allow the nozzle assembly to be readily screwed into the tube neck, but prevent any back-off so that the closure and nozzle remain tightly sealed to the tube at all times.

In accordance with one embodiment of the present invention, a tool for dispensing material from a deformable tube is provided. The deformable tube includes a tube body, a sealed first end, a neck, and a threaded discharge outlet. The tool comprises first and second casing halves which are joinable together to form a hollow outer casing. The casing halves, when joined together, form an aperture in an upper portion of the casing through which the discharge end of the deformable tube extends. The first and second casing halves include a circumferential shelf which is adapted to retain the neck of the tube in position.

An actuator which is inserted into the casing includes first and second opposing arms extending from a base, with each actuator arm comprising a jaw having an inwardly facing surface adapted to press against the deformable tube body and an outwardly facing gripping surface. The inwardly facing surfaces of each of the actuator arms comprise a first convex section adapted to conform to the outer surface of the tube body, and a second section angled away from the outer surface of the tube body and adapted to conform with the outer surface of the tube body without deforming the tube neck when the contents of the tube are maximally dispensed.

In some embodiments, the tool casing halves preferably include complementary interlocking projections in the upper portions thereof. In some embodiments, the casing halves include complementary bosses and apertures to aid in alignment of the casing halves. In some embodiments, the bosses are optionally tapered.

In some embodiments, each of the casing halves include a generally horizontally extending base half. In some embodiments, the base of the actuator includes a pair of ridges extending downwardly from each of the base halves, and each of the base halves of the casing halves includes a slot adapted to mate with a corresponding ridge on the actuator base. In some embodiments, each of the casing halves may include one or more guides which are adapted to align the actuator within the casing halves.

In some embodiments, the discharge outlet of the deformable tube includes external threads, and the tool further includes a dispensing nozzle which has internal threads which are adapted to engage the external threads of the discharge outlet. In some embodiments, the dispensing nozzle and the circumferential shelf on the casing halves include interengaging ratchets to lock the dispensing nozzle and casing against relative rotation. In some embodiments, the dispensing nozzle preferably includes external threads, and the tool further includes a cover which is adapted to threadedly engage the dispensing nozzle.

Accordingly, it is a feature of embodiments of the present invention to provide a tool which is relatively simple in design, is easy to manufacture and assemble, and which is capable of dispensing precise amounts of the fluid contents of a deformable tube until the contents have been substantially completely dispensed. Other features and advantages of embodiments of the present invention will be apparent from the following detailed description, the accompanying drawings, and the appended claims.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
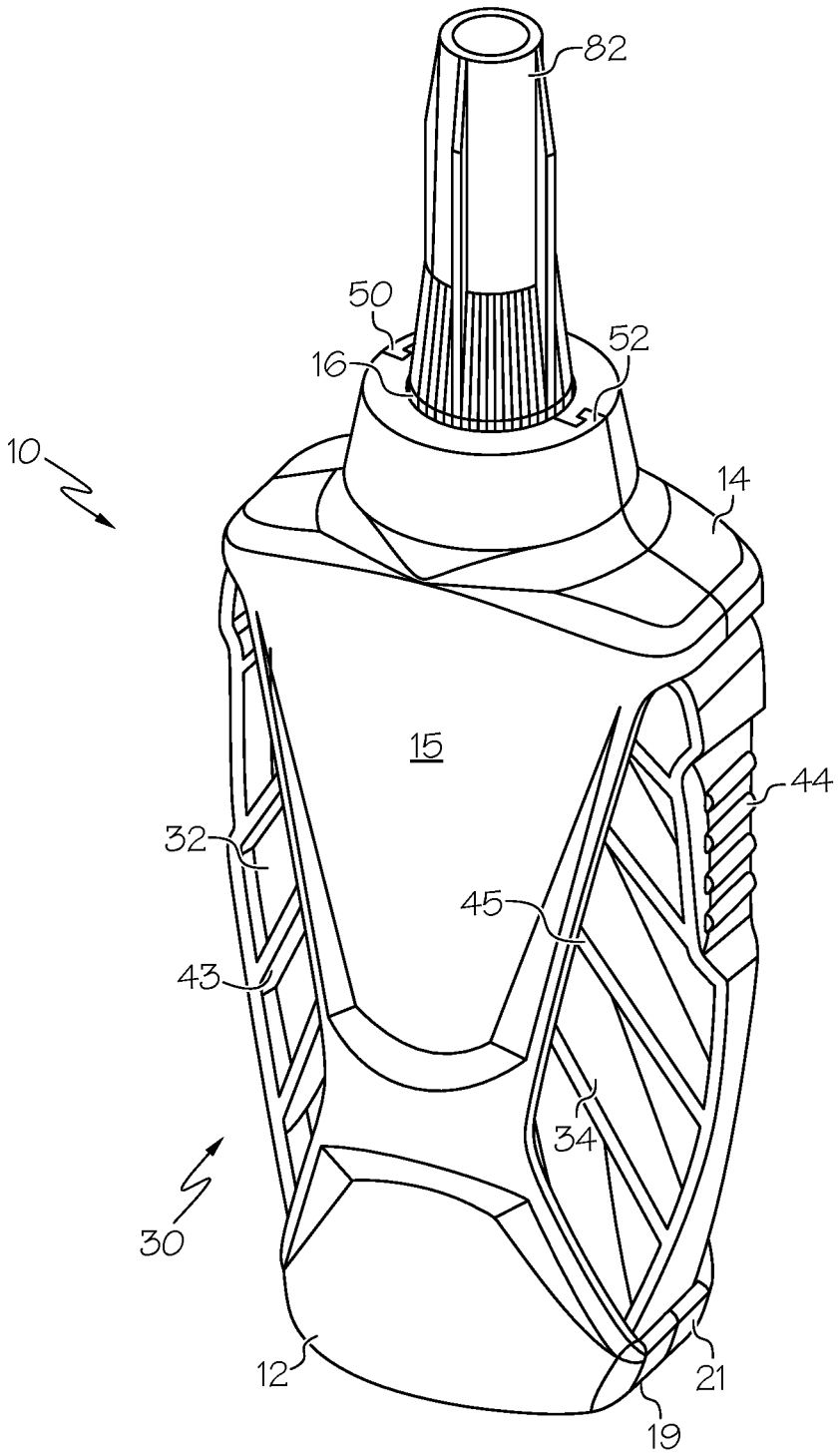
FIG. 1 is a perspective view of the assembled tool ready to dispense a liquid material.

Referring initially to FIG. 1, the assembled dispensing tool is shown in perspective. Dispensing tool 10 includes first and second casing halves 12, 14 which are joined together to form a hollow outer casing 15. As shown, the casing halves include complementary semi-circular openings at their respective top portions which are fitted together, for example, using interlocking projections 50, 52. In this manner, the casing halves readily snap together. A deformable tube (not shown in FIG. 1) containing a viscous liquid or gel is seated within the casing 15 as will be explained in greater detail below. The deformable tube typically will include a threaded neck (also not shown in FIG. 1) which extends into aperture 16.

Figure 2:
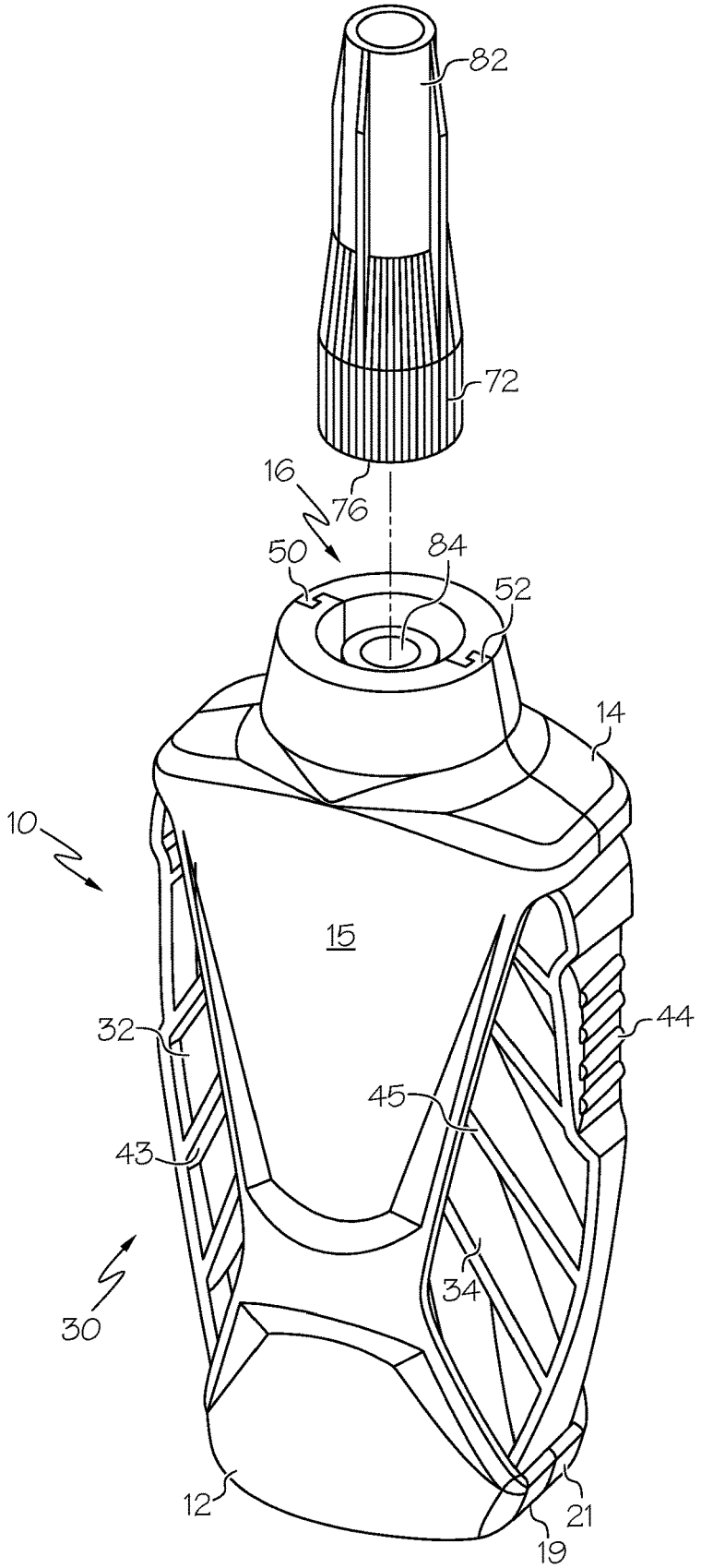
FIG. 2 is a perspective view of the tool as packaged, illustrating how the dispensing nozzle and cover are to be threaded onto the neck of the deformable tube.

In use, and as shown in FIG. 2, a dispensing nozzle 72 (only base is shown) and overcap or cover 82 are threaded onto the neck of the deformable tube, piercing a membrane seal 84 and rendering the tool 10 ready to dispense the contents of the deformable tube.

Figure 13:
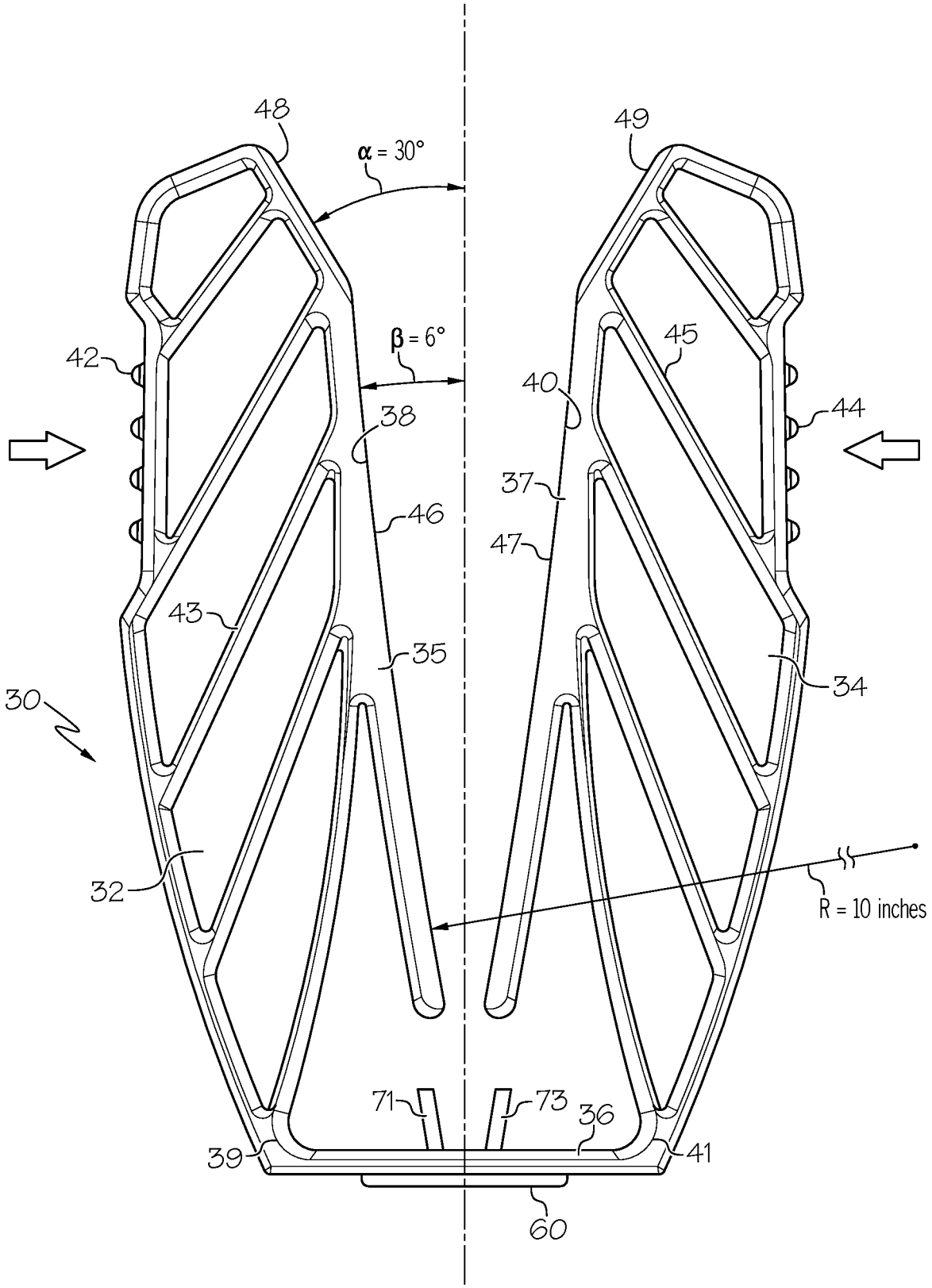
FIG. 13 is a front elevational view of the actuator.

Referring to FIGS. 1-3 and 13, dispensing tool 10 includes an actuator 30 which is inserted into the casing during assembly as will be explained in greater detail below. Actuator 30 comprises first and second opposing arms 32, 34 which extend from base 36. Each actuator arm comprises a jaw 35, 37, and each jaw includes a respective inwardly facing surface 38, 40. As shown in FIG. 13, we have found that forming the jaws to have an angle, R, of approximately 6° from vertical provides sufficient space for the deformable tube to be inserted into the tool. Varying the dimensions of the tool may result in the need to modify the angle. Actuator 30 and all of its components are formed from a substantially rigid material such as a rigid plastic or metal. By "substantially rigid," we mean that there is no bending or flexing of the inwardly facing surfaces of the jaws during the dispensing operation. When the jaws are squeezed in the direction of the arrows in FIG. 13, each jaw will flex about respective living hinges 39, 41 to dispense the contents of tube 20.

The inwardly facing surfaces 38, 40 have a convex profile which matches the profile of the deformable tube 20 during dispensing of the contents of the tube. This profile permits the operator of the dispensing tool to apply an even dispensing force along substantially the entire length of the tube so that a maximal amount of the contents of the tube are usefully dispensed. For example, we have found that for a tube length of approximately 2.5 inches, a tube diameter of approximately 0.5 inches, forming inwardly facing surfaces with a radius, R (see FIG. 13), of approximately 10 inches produces a squeezing action that dispenses a maximal amount of the contents of the tube. For other tube sizes and diameters, other optimal radii can be readily determined.

As also shown, actuator 30 includes complementary outwardly facing gripping surfaces 42, 44 for the user. For example, using a thumb and forefinger, a user can readily grip the tool and squeeze the jaws to dispense precise amounts of the contents of the tube. The actuator may also include reinforcing components such as, for example, ribs 43, 45, to aid in maintaining the rigidity of the jaws during operation.

The jaws of actuator 30 also include respective second sections 48, 49 adjacent the upper end of the actuator which are angled away from the outer surface 23 of deformable tube body 22. As shown in FIG. 13, we have found that if these sections are formed at an angle, a, of approximately 30° provides sufficient clearance for these sections of the jaws to avoid impinging upon the neck of the tube. Of course, if the dimensions of the tool are changed, this angle may also need to be changed. These sections of the jaws are sized and positioned such that, when a tube is seated in the tool after assembly, and a user applies squeezing pressure to the tube, the neck of the tube is not deformed even after substantially the entire contents of the tube have been dispensed. The angled sections 48, 49 are located such that sufficient space is left for the neck of the tube to remain intact. We have found that without angled sections 48, 49, the inwardly facing surfaces of the jaws on the actuator will start to deform the neck, the strongest part of the tube, before the entire contents of the tube have been dispensed. Deformation of the tube neck is disadvantageous because it requires a user to apply a much greater amount of force to attempt to dispense a small amount of residual fluid. This limits the amount of fluid that a user can dispense, wasting adhesive or the like that the user has paid for. The neck may also crack or tear, causing leakage of the tube's contents and again wasting adhesive.

Figure 3:
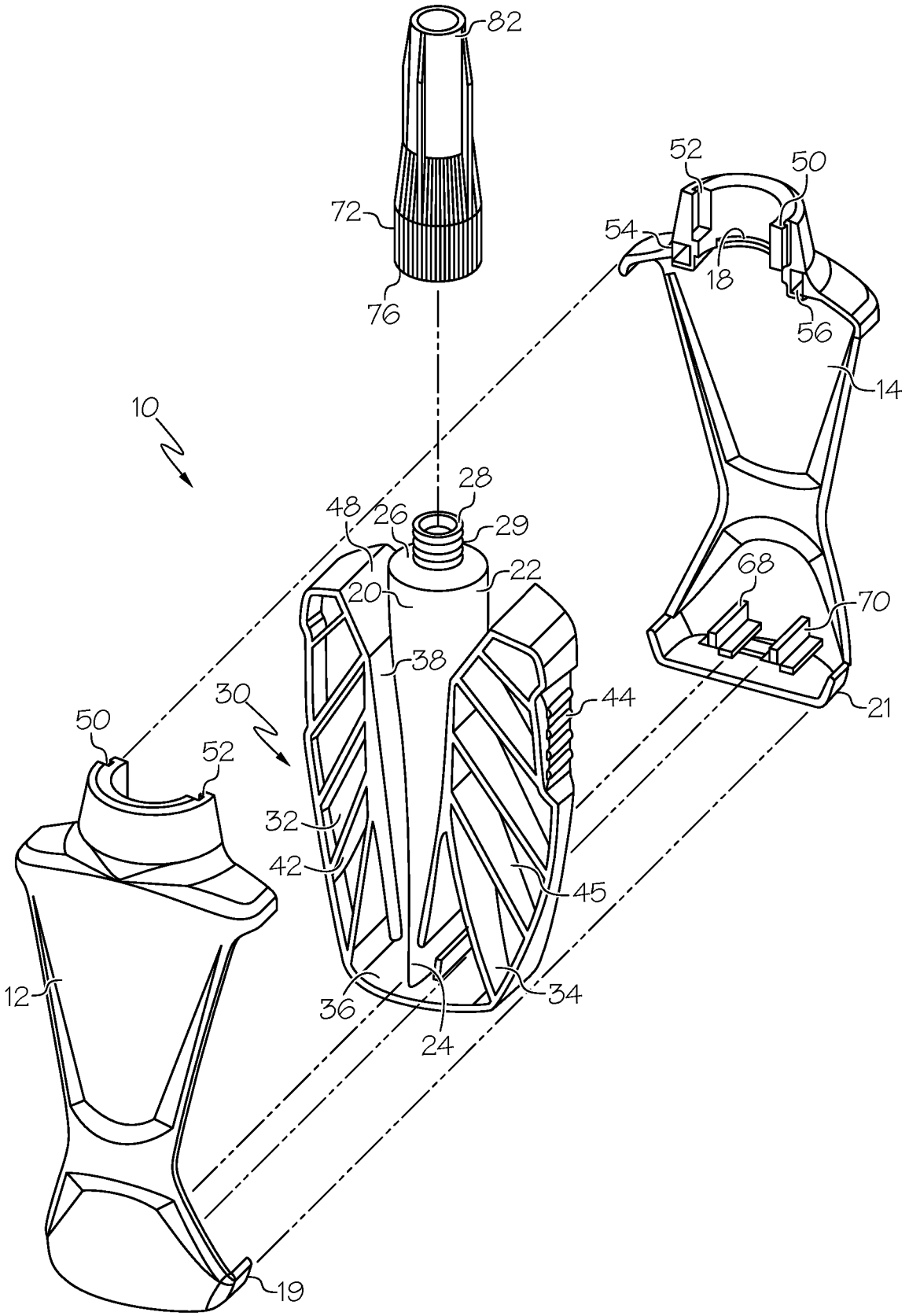
FIG. 3 is an exploded view of the tool depicting the actuator, deformable tube, casing halves, and dispensing nozzle and cover.
Figure 4:
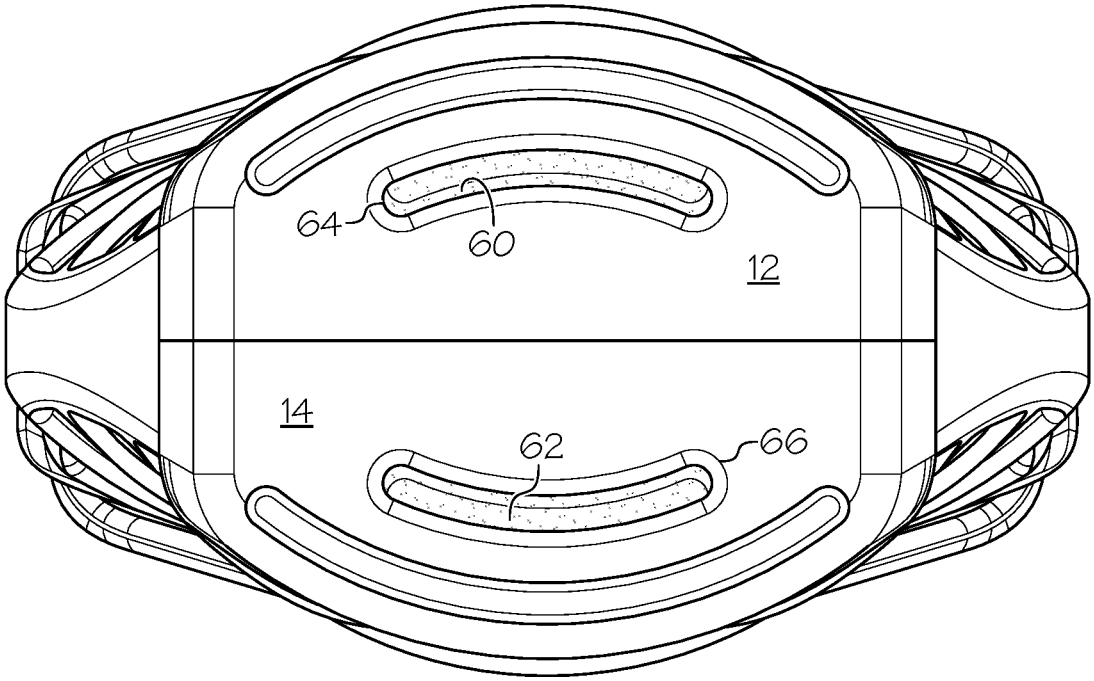
FIG. 4 is a bottom elevational view of the assembled tool depicting how ridges extending from the actuator base engage the slots on the casing halves.
Figure 5:
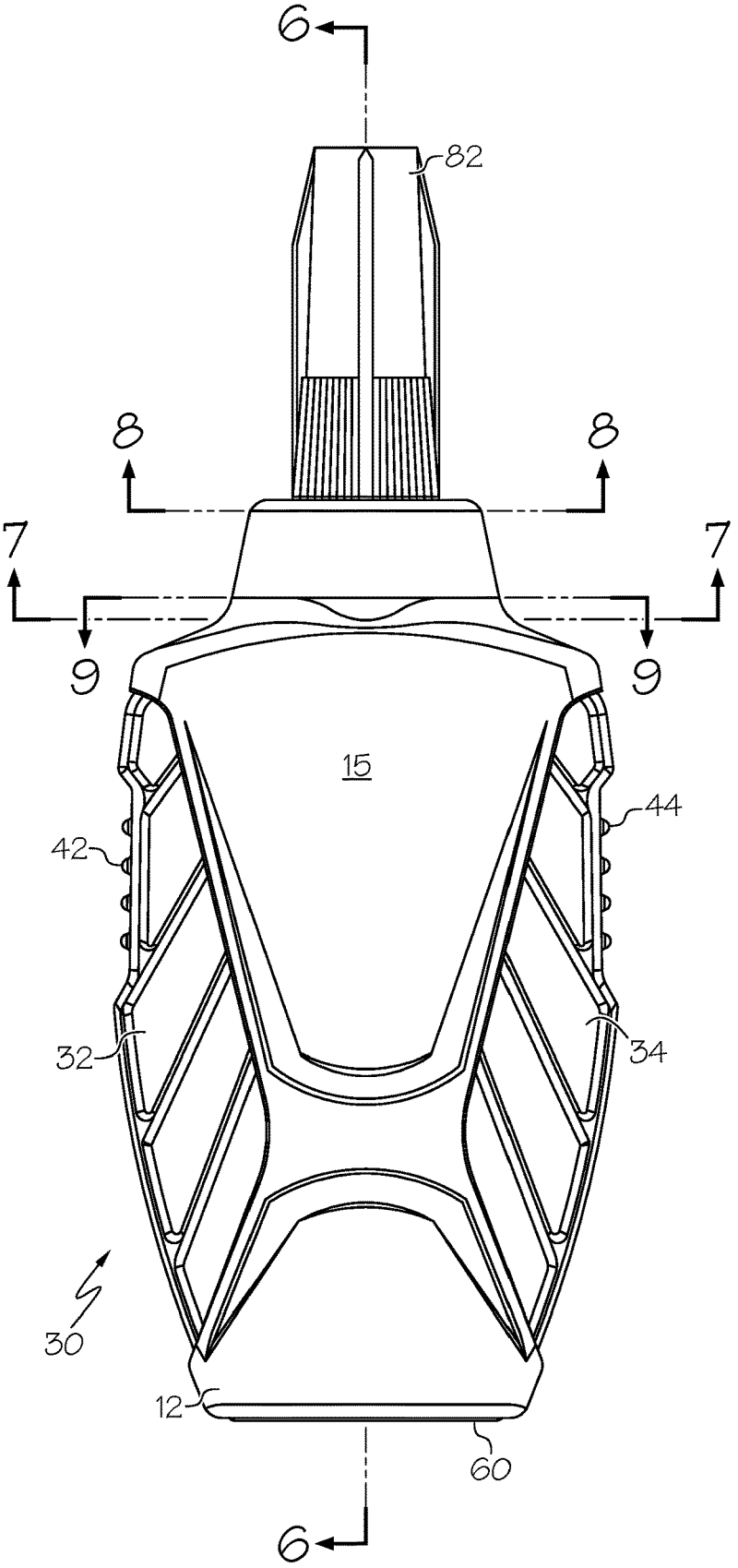
FIG. 5 is a front elevational view of the assemble tool.

FIG. 4 illustrates the structural features of the base of tool 10 and how the casing halves 12, 14 and actuator 30 are fitted together. As shown in FIGS. 3 and 13, deformable tube 20 is inserted into the space between actuator jaws 35, 37 such that the sealed first end 24 of the tube is seated between upstanding legs 71, 73 on base 36 of the actuator. As can be seen, the legs 71, 73 may be angled outwardly to increase the ease of properly positioning the tube. The actuator and tube are then inserted into casing half 14. Guides 68, 70 on the casing half aid in properly aligning the actuator. As best seen in FIG. 4, ridge 62 on actuator base 36 snaps into slot 66 to retain the actuator in the casing half.

Figure 7:
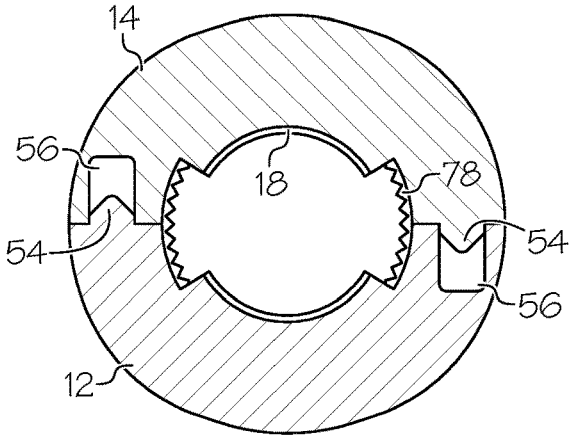
FIG. 7 is a top sectional view taken along line 7-7 in FIG. 5 depicting a retention feature for the deformable tube within the casing and an alignment feature for the casing halves.
Figure 8:
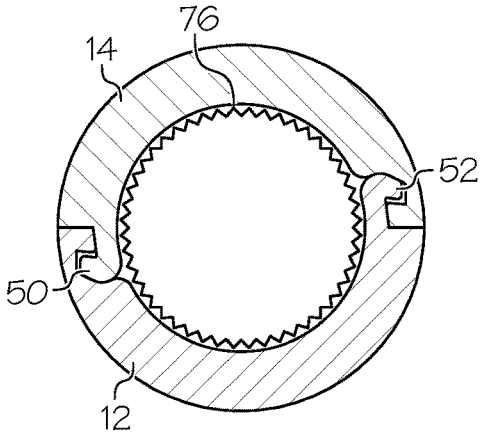
FIG. 8 is a top sectional view taken along line 8-8 in FIG. 5 depicting the interlocking projections on the casing halves.
Figure 9:
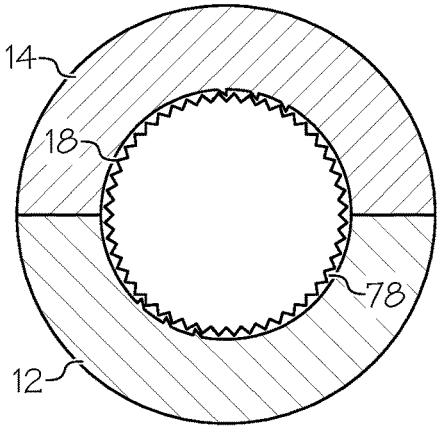
FIG. 9 is a top sectional view taken along line 9-9 in FIG. 5 depicting the ratchet mechanism on the dispensing nozzle.

Then, casing half 12 is pressed against the actuator. Again, corresponding guides extending from adjacent the base of the casing half 14 aid in properly aligning the casing halves. Adjacent the upper portions of casing halves 12, 14 complementary interlocking projections 50, 52 and complementary posts and apertures 54, 56 are located on each of the casing halves. As the casing halves are pressed together, posts 54 are guided into apertures 56 to properly align the casing halves. The completed construction is shown in FIG. 7. Posts 54 may have an angled shape, as shown, or otherwise be contoured to slide into the apertures and improve the alignment process. Simultaneously, interlocking projections 50, 52 snap together, and ridge 60 on the actuator base snaps into slot 64 in casing half 12, securely locking the parts of the tool together. The completed construction is shown in FIG. 1.

Figure 6:
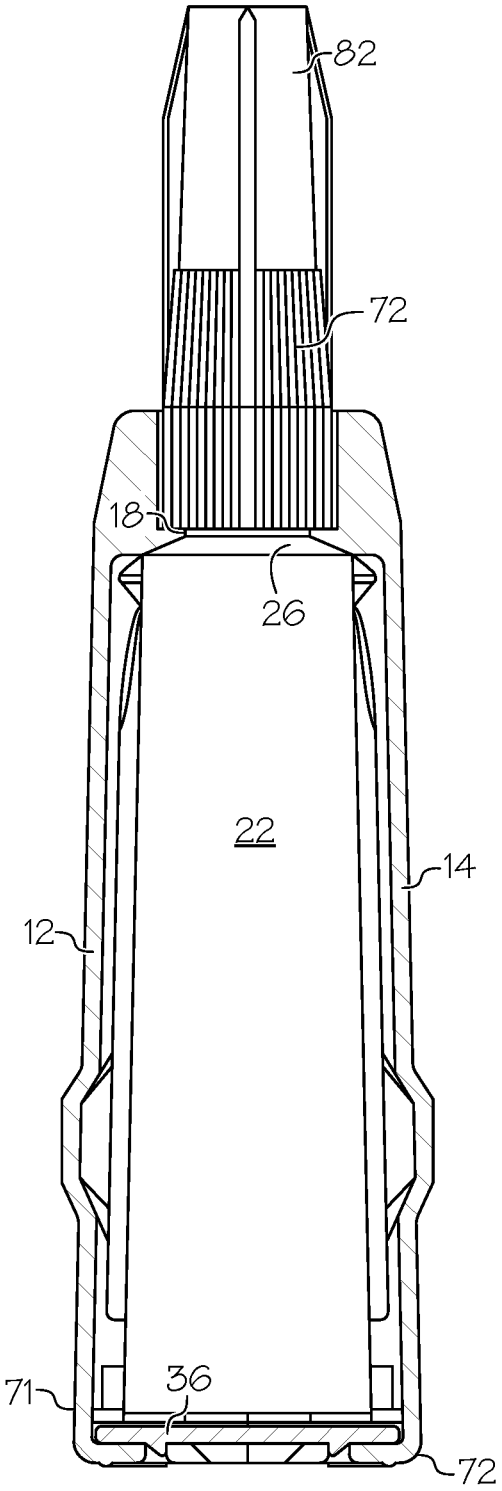
FIG. 6 is a side sectional view of the tool taken along line 6-6 in FIG. 5 depicting the retaining ledge for the deformable tube and the locking and alignment features for the base of the tool.

As shown in FIGS. 3 and 6, as the tool is assembled, the neck 26 of deformable tube 20 fits snugly against the bottom side of circumferential shelf 18. This positions the tube properly both for attachment of the dispensing nozzle 72 and cover/cap 82, as well as providing proper clearance for the actuator jaws to maximally dispense fluid from the tube without deforming the tube neck.

Figure 10:
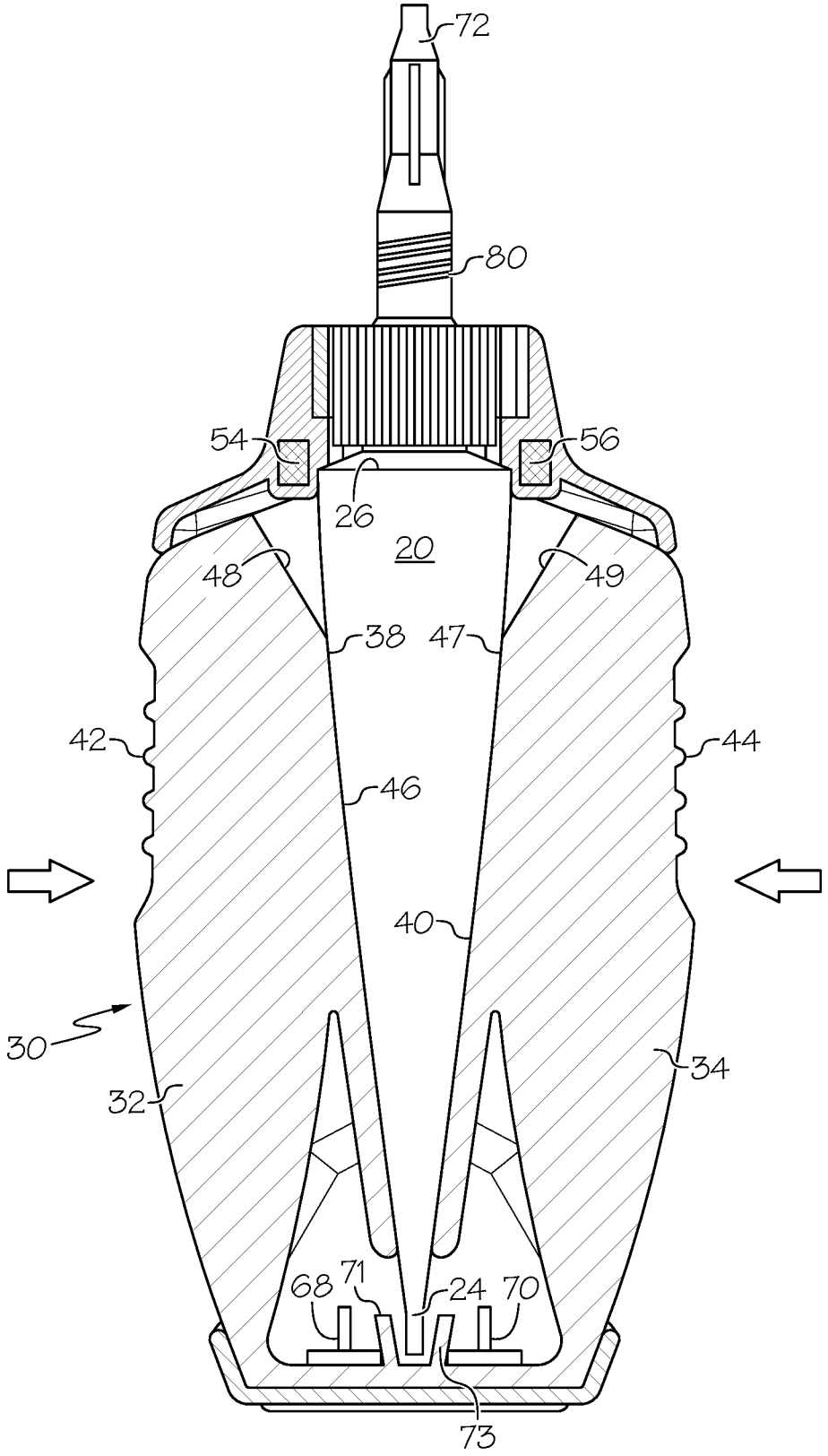
FIG. 10 is a front sectional view of the tool depicting the deformable tube with the actuator fully open.

FIGS. 2, 3, and 10 illustrate dispensing nozzle 72 and cover 82 which are pre-assembled by screwing the two together using the external threads 80 on dispensing nozzle 72 and internal threads on the cover. As shown, when a user wishes to activate the tool and dispense the contents of the tube, the nozzle/cover assembly is screwed onto the threaded neck 29 of the tube 20. This causes membrane seal 84 in discharge outlet 28 to rupture, making the tool ready for use.

As best shown in FIGS. 1, 7-9, and 10, the underside of dispensing nozzle 72 includes ratchet teeth 76 which mate with corresponding ratchet teeth 78 which are located on circumferential shelf 18 of the casing. The teeth are designed so that the cover/nozzle assembly can be screwed onto the tube neck using a clockwise rotation. However, counterclockwise rotation of the dispensing nozzle is prevented, insuring that once the cover/nozzle is screwed onto the tube, the nozzle cannot be removed. This construction permits counterclockwise rotation of cover 82 to disengage it from dispensing nozzle 72 so that a user can dispense the contents of the tube. Once a desired amount of fluid is dispensed, the cover can then be screwed back onto the nozzle to re-seal the tube for later use.

Figure 11:
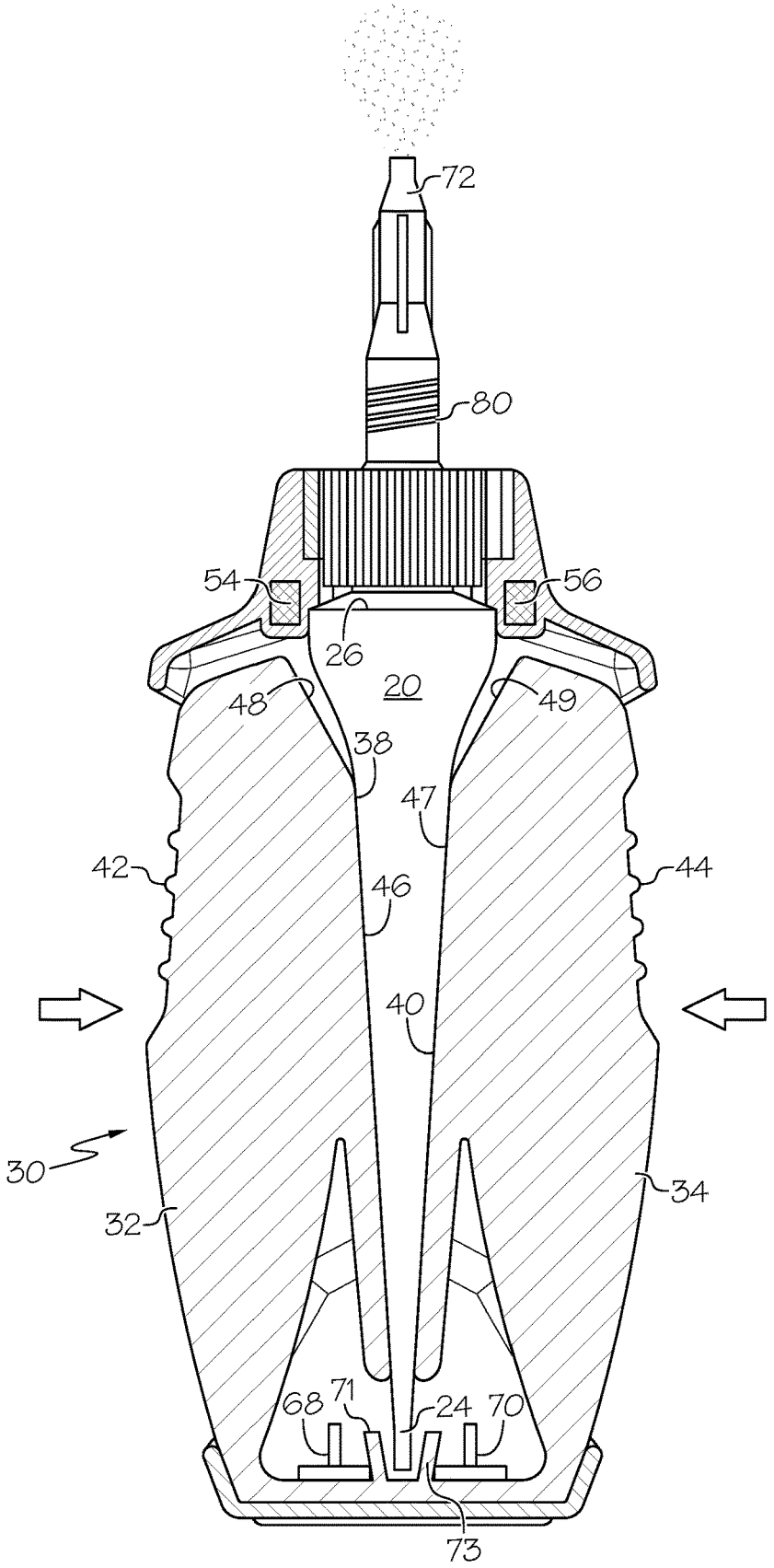
FIG. 11 is a front sectional view depicting the actuator arms being partially squeezed together to dispense liquid from the deformable tube.
Figure 12:
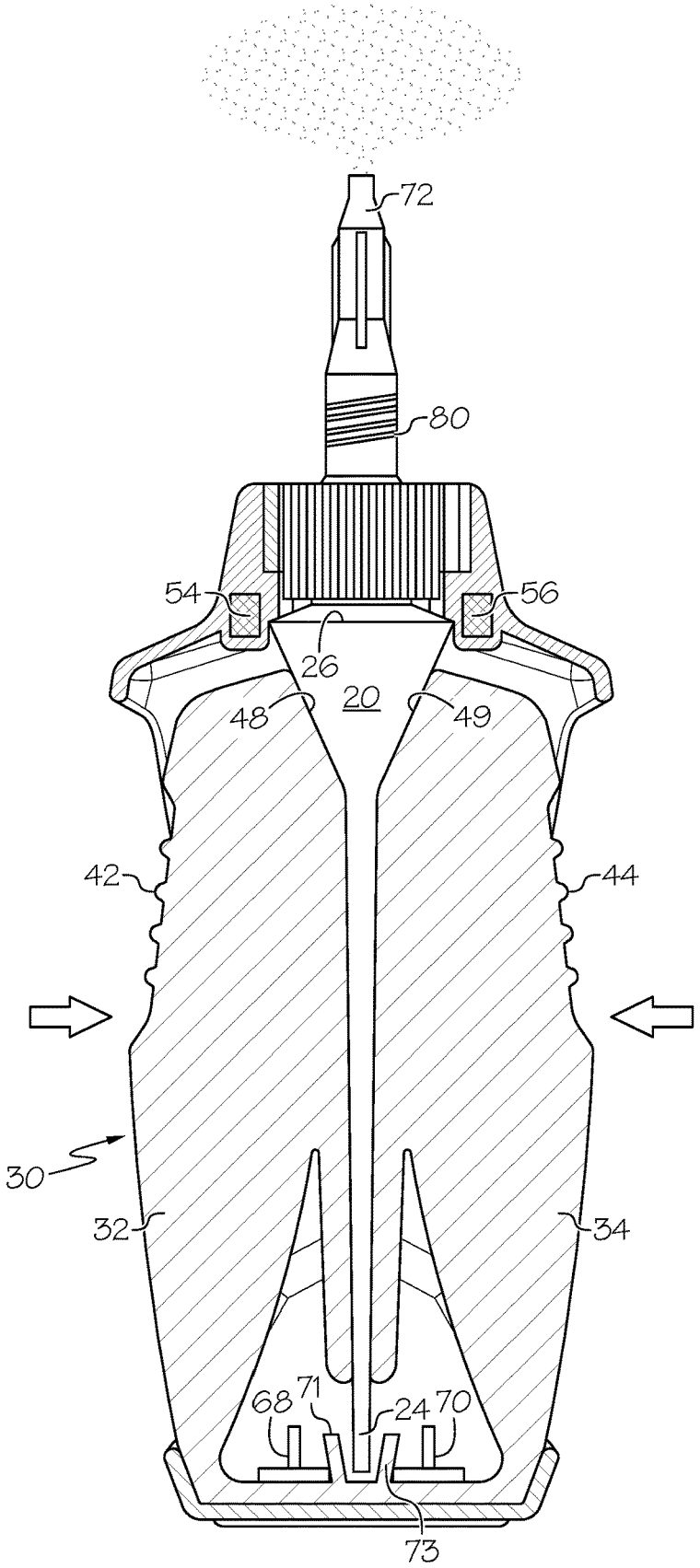
FIG. 12 is a front sectional view depicting the actuator arms fully closed without deforming the neck of the tube.

The sectional views in FIGS. 10-12, in conjunction with FIGS. 3 and 13, illustrate the operation of tool 10 to dispense the contents of tube 20. In FIG. 10, overcap/cover 82 has been removed, and nozzle 72 has been screwed into the threads on the neck of tube 20. With the deformable tube properly seated, with neck 26 positioned against circumferential shelf 18, and with the sealed first end 24 of the tube positioned between legs 71, 73, the tool is ready for use. A user can dispense the fluid contents from the tube by squeezing gripping surfaces 42, 44 in the direction of the arrows. Inwardly facing surfaces 38, 40 on rigid jaws 35, 37 engage the body of the tube.

FIG. 11 illustrates the contents of the tube being dispensed as the user continues to exert pressure in the direction shown by the arrows. As can be seen, actuator 30 is sized such that outwardly angled second sections 48, 49 do not yet engage the tube body and are located below tube neck 26 to avoid deformation of the tube neck and any changes in the necessary squeezing force applied by a user. FIG. 12 illustrates the condition when the actuator jaws have been fully closed, dispensing substantially the entire contents of the tube. As can be seen, the convex sections 46, 47 of the jaws on the actuator have fully engaged the tube body, resulting in the dispensing of a maximal amount of the contents of the tube. Also, outwardly angled second sections 48, 49 have engaged the outer surface of the tube body to aid in dispensing the contents of the tube. However, as discussed above, those sections are positioned below the neck of the tube and do not cause any deformation of the neck, even when the jaws are fully closed.

The tool of the present invention is suitable for dispensing low viscosity liquids, as well as higher viscosity gels or pastes in a precise manner from a deformable tube. In some embodiments, the contents of the tube comprise an adhesive such as a cyanoacrylate adhesive. It will be apparent to skilled persons that the tool may be useful in dispensing a wide variety of other fluid materials.

In order that embodiments of the invention may be better understood, the following examples are presented. However, particular materials, sizes, and amounts presented in the Examples should not be construed to limit the overall scope of the invention.

Example 1

Metal tubes containing approximately 5 gm of cyanoacrylate liquid adhesive were obtained from Adhesive Systems, Inc., Frankfort, Ill. Tests were performed to measure the amount of force required to dispense adhesive from the tubes versus the amount of force required when the metal tube neck becomes involved in the dispensing process. The results are shown in Table 1 below.

TABLE 1

| Sample | Force to Squeeze Tube and Dispense Product (lbs) | Force to Deform Neck and Dispense Product (lbs) |
|---|---|---|
| 1 | 7 | 15 |
| 2 | 8 | 15 |
| 3 | 9 | 14 |
| 4 | 9 | 16 |
| 5 | 8 | 18 |
| 6 | 9 | 16 |
| 7 | 7 | 16 |
| 8 | 8 | 16 |
| 9 | 7 | 18 |
| 10 | 8 | 14 |
| Mean | 8.0 | 15.8 |
| Std. Dev. | 0.8 | 1.4 |

The squeezing force required was measured using a Baseline Hydraulic Hand Dynamometer manufactured by Fabrication Enterprises, Inc., Irvington, N.Y. The tubes were squeezed with enough force to continuously dispense product through an attached nozzle. The metal tube shoulders/necks were squeezed using the minimal force which would cause deformation of the neck, visually recorded as the point at which the shoulder radius of the tube was bent downwardly. The test results show that an evenly applied force provides a continuous flow of product dispensed from the tube. However, if the metal neck of the tube becomes involved in the dispensing process, the amount of force required to dispense product almost doubles.

Example 2

Tests were performed to compare the amounts and percentages of adhesive dispensed from tools made in accordance with the embodiments of the present invention described above and illustrated in the accompanying drawings (identified in the Table as "FIG. 1"). The tools were assembled with metal tubes containing approximately 5 gm of cyanoacrylate liquid adhesive obtained from Adhesive Systems, Inc., Frankfort, Ill. For comparison, 10 Loctite® Super Glue Ultra Liquid Control dispensers, manufactured by Henkel Corporation were purchased at retail (identified in the Table as "Loctite Liquid"). For the tests, adhesive was dispensed by squeezing with both hands until no more adhesive came out of the devices. The amounts of dispensed adhesive were then weighed. The total fill weight of each of the tubes was determined by removing the adhesive-containing tubes from the respective dispensing tools, further squeezing each tube by hand, followed by squeezing each tube with pliers, including tube neck deformation, to dispense any remaining adhesive. Those amounts were also measured and added to the previous dispensed amounts to arrive at values for total fill weights. The results are reported in Table 2 below.

TABLE 2

| Product | Sample | Dispensed Weight (gm) | Total Fill Weight in Tube (gm) | % Dispensed | Mean % Dispensed | Std. Deviation % Dispensed |
|---|---|---|---|---|---|---|
| Loctite Liquid | C1 | 2.76 | 3.35 | 82.4 | | |
| Loctite Liquid | C2 | 2.84 | 3.75 | 75.7 | | |
| Loctite Liquid | C3 | 3.08 | 3.79 | 81.3 | 77.3% | 0.037 |
| Loctite Liquid | C4 | 2.64 | 3.81 | 69.3 | | |
| Loctite Liquid | C5 | 3.00 | 3.80 | 78.9 | | |
| Loctite Liquid | C6 | 2.82 | 3.74 | 75.4 | | |
| Loctite Liquid | C7 | 2.79 | 3.67 | 76.0 | | |
| Loctite Liquid | C8 | 3.03 | 3.77 | 80.4 | | |
| Loctite Liquid | C9 | 2.85 | 3.73 | 76.4 | | |
| Loctite Liquid | C10 | 2.91 | 3.75 | 77.6 | | |
| FIG. 1 | 1 | 4.67 | 5.39 | 86.6 | 92.1% | 0.038 |
| FIG. 1 | 2 | 4.24 | 4.32 | 98.1 | | |
| FIG. 1 | 3 | 4.26 | 4.57 | 93.2 | | |
| FIG. 1 | 4 | 4.72 | 5.31 | 88.9 | | |
| FIG. 1 | 5 | 4.26 | 4.56 | 93.4 | | |
| FIG. 1 | 6 | 4.83 | 5.24 | 92.2 | | |
| FIG. 1 | 7 | 5.00 | 5.59 | 89.4 | | |
| FIG. 1 | 8 | 4.30 | 4.45 | 96.6 | | |
| FIG. 1 | 9 | 4.40 | 4.65 | 94.6 | | |
| FIG. 1 | 10 | 4.05 | 4.59 | 88.2 | | |

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the terms "substantially" and "approximately" are utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Unless the meaning is clearly to the contrary, all ranges set forth herein are deemed to be inclusive of all values within the recited range as well as the endpoints.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

The invention claimed is:

1. A tool for dispensing material from a deformable tube comprising a tube body, a sealed first end, a neck, and a discharge outlet, said tool comprising:

first and second casing halves joinable together to form a hollow outer casing, the casing halves, when joined together, forming an aperture in an upper portion of the casing through which the discharge end of said deformable tube extends, said first and second casing halves including a circumferential shelf adapted to retain said neck of said tube;

an actuator insertable into said casing, said actuator having first and second opposing arms extending from a base, each actuator arm comprising a jaw having an inwardly facing surface adapted to press against said deformable tube body and an outwardly facing gripping surface, the inwardly facing surfaces of each of said actuator arms comprising a first convex section adapted to conform to the outer surface of the tube body, and a second section angled away from said outer surface of said tube body and adapted to conform with the outer surface of said tube body without deformation of said tube neck when the contents of said tube are maximally dispensed, wherein said second section angled away from said outer surface of said tube body is angled at an angle of approximately 30°.

2. A tool as claimed in claim 1 in which the jaws of said actuator are substantially rigid.

3. A tool as claimed in claim 1 in which said casing halves include complementary interlocking projections in said upper portions thereof.

4. A tool as claimed in claim 1 in which said casing halves include complementary bosses and apertures to aid in alignment of said casing halves.

5. A tool as claimed in claim 4 in which said bosses are tapered.

6. A tool as claimed in claim 1 in which each of said casing halves includes a generally horizontally extending base half.

7. A tool as claimed in claim 6 in which said base of said actuator includes a pair of ridges extending downwardly from each of said base halves, and each of said base halves of said casing halves includes a slot adapted to mate with a corresponding ridge on said actuator base.

8. A tool as claimed in claim 7 in which each of said casing halves includes one or more guides adapted to align said actuator within said casing halves.

9. A tool as claimed in claim 1 in which said discharge outlet of said deformable tube includes external threads, and said tool further includes a dispensing nozzle comprising internal threads adapted to engage said external threads of said discharge outlet.

10. A tool as claimed in claim 9 in which said dispensing nozzle and said circumferential shelf on said casing halves include interengaging ratchets to lock said dispensing nozzle and casing against relative rotation.

11. A tool as claimed in claim 10 in which said dispensing nozzle includes external threads, and said tool further includes a cover adapted to threadedly engage said dispensing nozzle.

12. A tool as claimed in claim 1 in which said first convex section has a radius of approximately 10 inches.

* * * * *